US006925933B1

(12) United States Patent
Shih

(10) Patent No.: US 6,925,933 B1
(45) Date of Patent: Aug. 9, 2005

(54) PORTABLE STAMP

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/823,760

(22) Filed: Apr. 14, 2004

(51) Int. Cl.[7] ..... B41K 1/42; B41F 31/00; B41F 1/00

(52) U.S. Cl. ..... 101/333; 101/327; 101/479; 101/483

(58) Field of Search ..... 101/333, 327, 101/479, 483

(56) References Cited

U.S. PATENT DOCUMENTS 5,105,738 A * 4/1992 Mehaffey ..... 101/333
5,123,349 A * 6/1992 Beaver et al. ..... 101/333
5,191,837 A * 3/1993 Bolton ..... 101/333
6,834,584 B1 * 12/2004 MacNeil ..... 101/333

* cited by examiner

*Primary Examiner*—Andrew H. Hirshfeld
*Assistant Examiner*—Marvin P. Crenshaw
(74) *Attorney, Agent, or Firm*—Rosenberg, Klein & Lee

(57) ABSTRACT

A portable stamp includes a housing with an elongated slot and a tongue. A handle is movably mounted in the housing. A character unit is pivotally mounted at a distal end of the handle with a first torsion spring. An ink pad is pivotally mounted beneath the character unit with a second torsion spring and abuts a character plate of the character unit. A control unit is movably mounted in the elongated slot and stably mounted in the handle. A cover is detachably mounted at an open end of the housing. When the control unit is pushed towards the open end of the housing, the character unit and ink pad will be respectively pivoted under the forces of the torsion springs to positions perpendicular to the handle for stamping the character plate. Whereby, the stamp is easy to be operated and will not dirty the user's hands.

7 Claims, 12 Drawing Sheets

PORTABLE STAMP

BACKGROUND OF THE INVENTION

1. Field of the Invention

The present invention relates to a portable stamp, and more particularly to a stamp which is easy to be operated and will not dirty a user's hands.

2. Description of Related Art

With reference to FIGS. 12–13, a conventional portable stamp, as described in U.S. Pat. No. 6,708,613, has a handle (70) with an open end. A linkage (71) is mounted in the handle (70) and extends outwards from the open end of the handle (70). A character unit (73) is pivotally mounted on a distal end of the linkage (71) by a first pivot member (72) and a character plate (74) is formed at an outer surface opposite to the hinge (72).

An ink pad (77) is pivotally mounted beside the linkage (71) by a second pivot member (75) with a torsion spring (76). An ink sponge (78) is provided on the ink pad (77). A cover (79) is mounted at the open end of the handle (70) to receive the character unit (73) and the ink pad (77).

In a received status where the cover (79) is mounted at the open end of the handle (70), as shown in FIG. 12, the character unit (73) is pivoted to abut the linkage (71), and the character plate (74) abuts the ink sponge (78) to receive ink.

When a user removes the cover (79), under the force of the torsion spring (76), the ink pad (77) is pushed to turn downward. Meanwhile, the character unit (73) can automatically pivot downwards to a position perpendicular to the linkage (71), so the user can stamp a document with the character plate (74). If the user holds the stamp in the situation of the character unit (73) above the linkage (71), the character unit (73) will not pivot downwards by itself. Thus, the user must manually turn the character unit (73) for stamping, which makes use of the stamp very inconvenient.

After stamping, the user must respectively turn the character unit (73) towards the linkage (71) and the ink pad (77) inwards, and then attach the cover (79) to the handle (70). Thus, the user's hands are often dirtied with ink.

Moreover, after continuously stamping documents for sometime, the character plate (74) will not have enough ink to print a clear mark and needs to be re-coated with ink. The user must return the character unit (73) and ink pad (77) into the cover (79) to re-coat the character plate (74) with ink for further stamping. It is also very inconvenient for the user to repeat this process, and it is easy for the user's hands to become dirtied.

Furthermore, the character unit (73) is pivotally mounted on the linkage (71), and so it is difficult to stamp the character plate (74) with an even pressure to print the mark clearly.

Therefore, the invention provides a portable stamp to mitigate or obviate the aforementioned problems.

SUMMARY OF THE INVENTION

The main objective of the present invention is to provide a portable stamp which is easy to be operated and will not dirty a user's hands.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
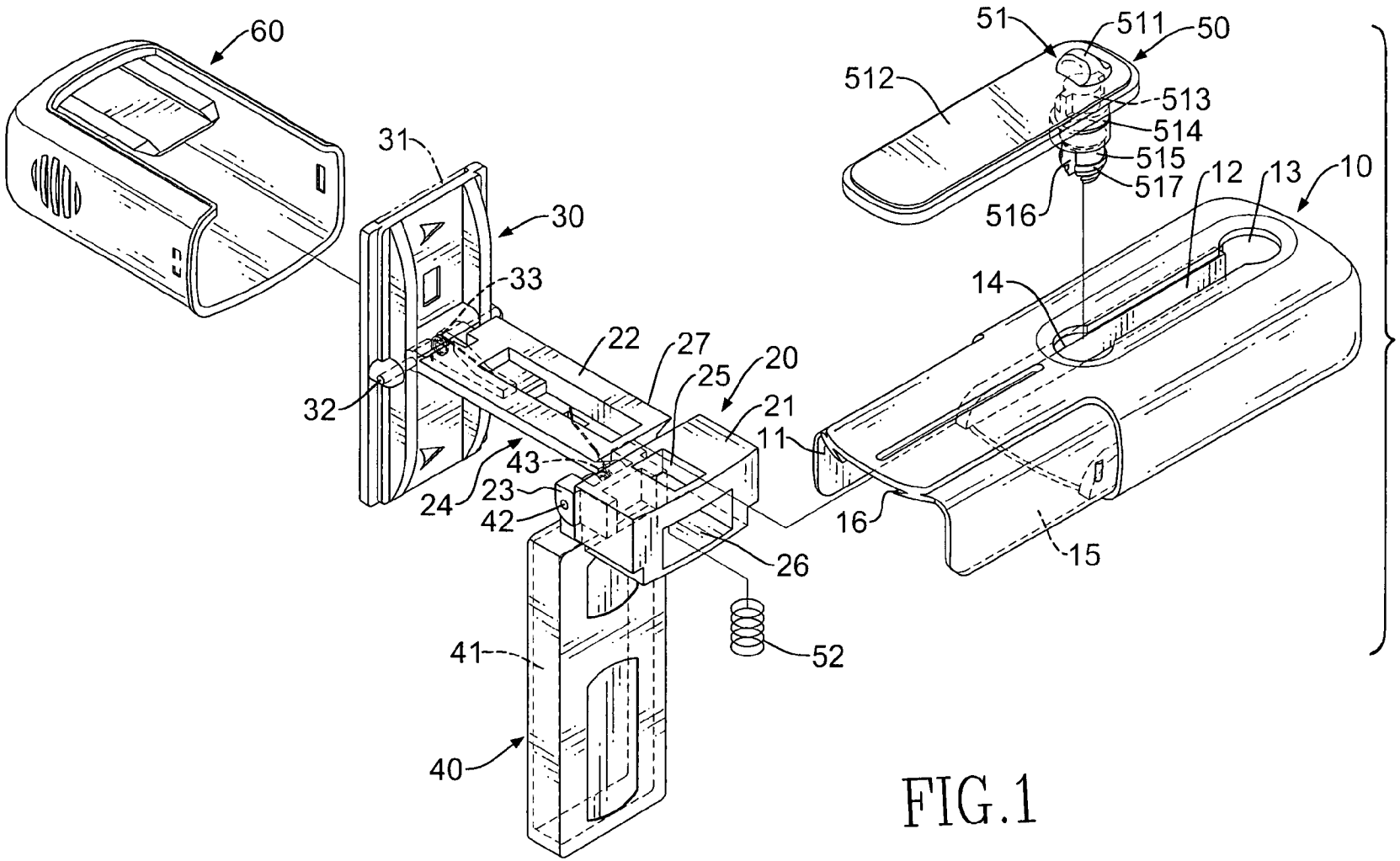
FIG. 1 is an exploded perspective view of a portable stamp in accordance with the present invention.
Figure 2:
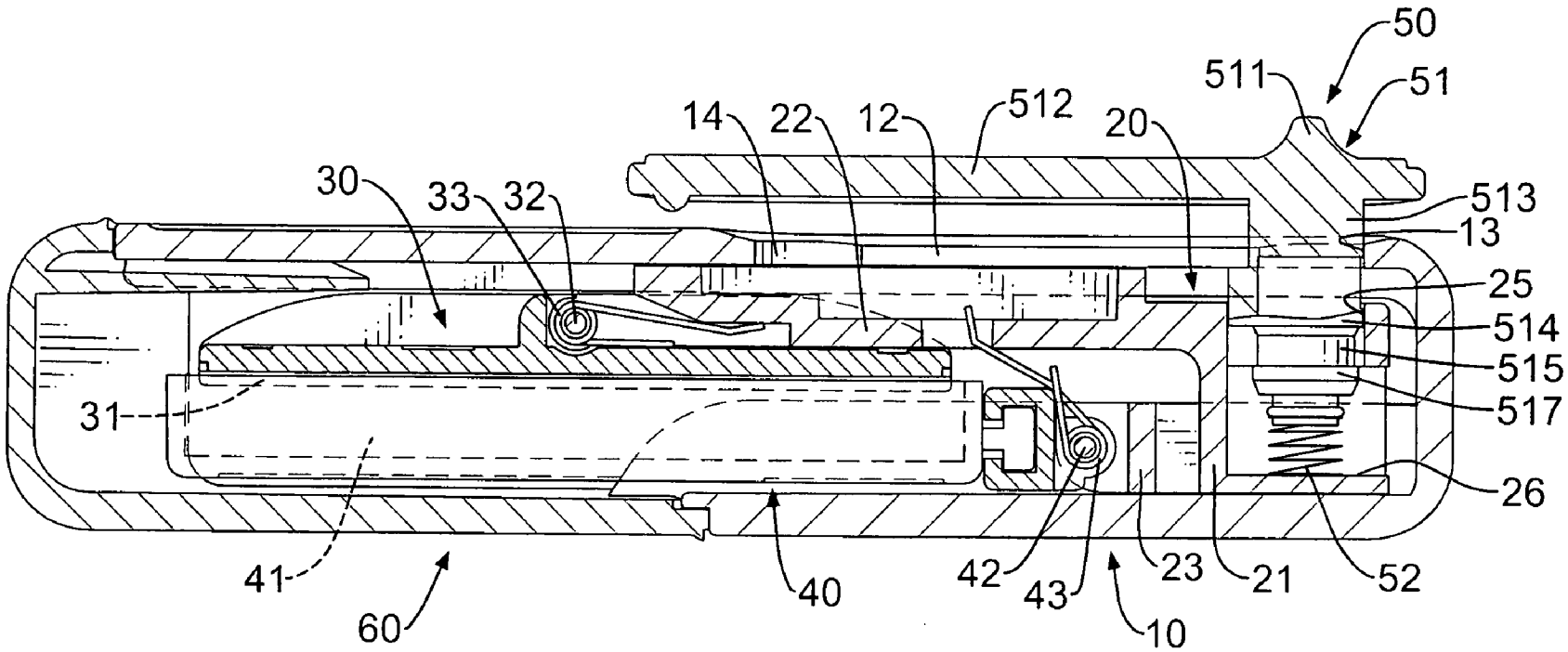
FIG. 2 is a front sectional view of the portable stamp in a received status.
Figure 3:
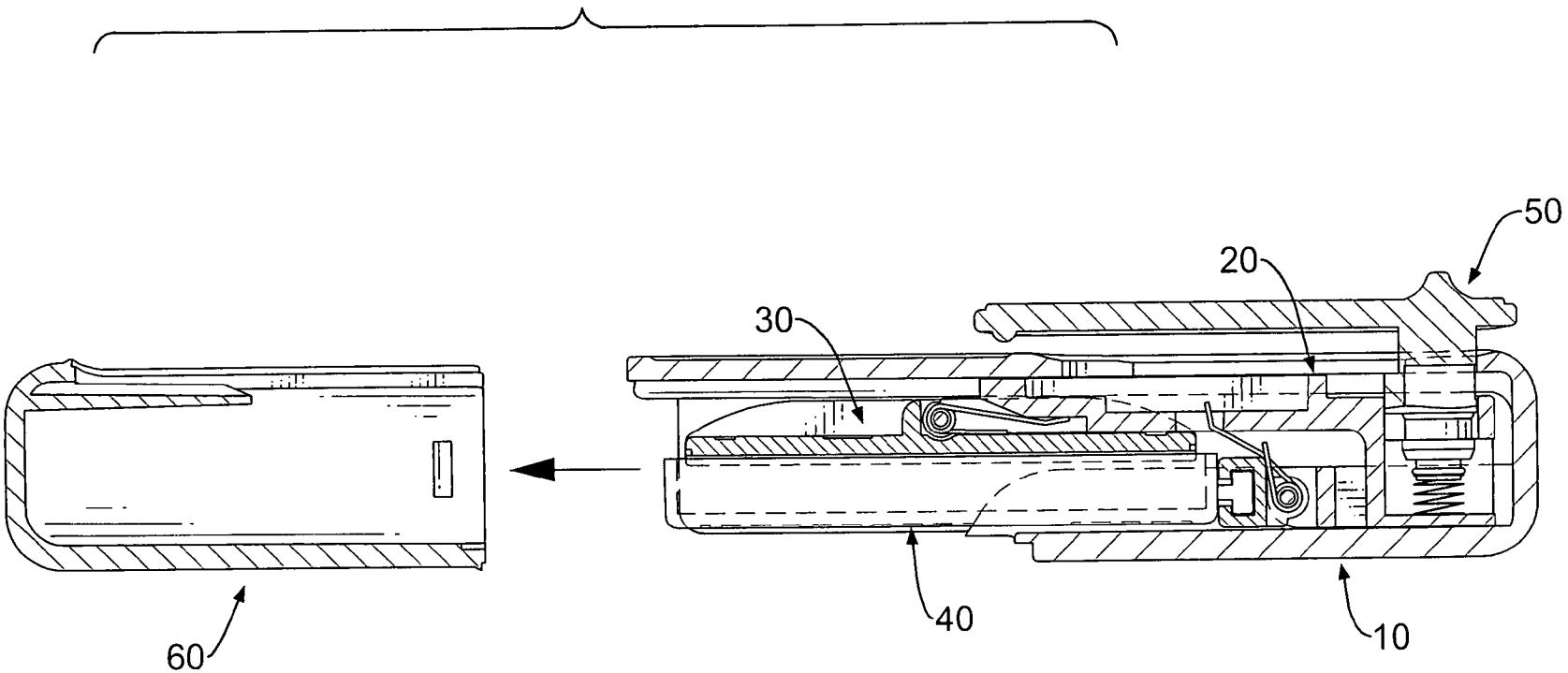
FIG. 3 is a schematic view showing that a cover of the portable stamp is detached.
Figure 5:
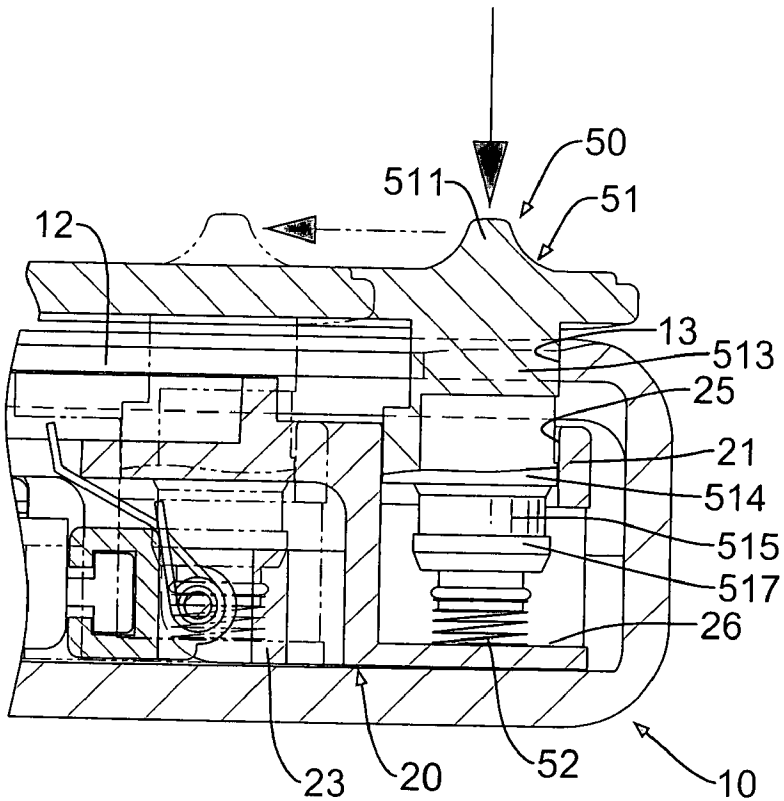
FIG. 5 is a partially enlarged sectional view of the control unit being pressed downwards.
Figure 4:
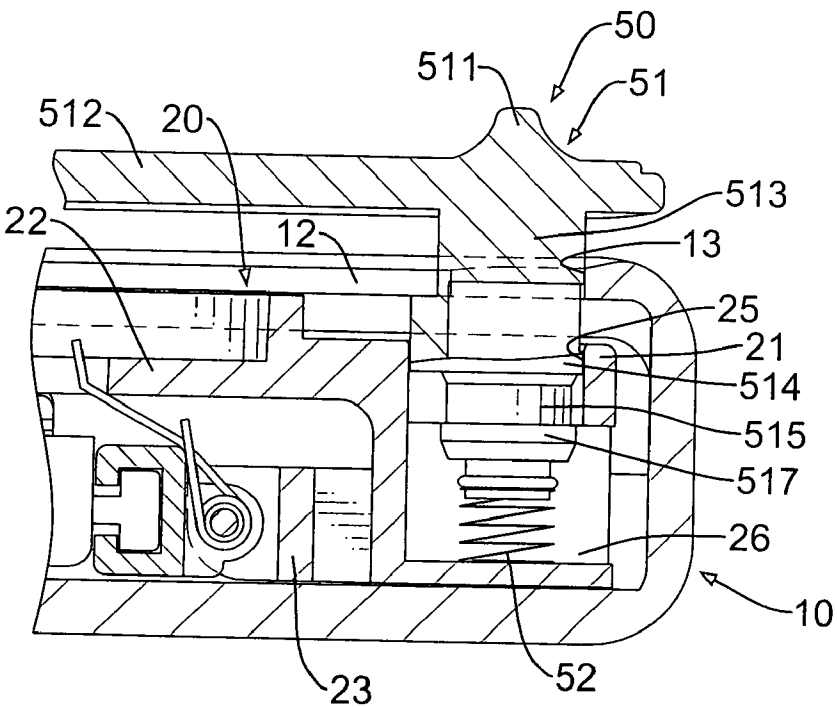
FIG. 4 is a partially enlarged sectional view of a housing, a handle, and a control unit of the portable stamp.
Figure 6:
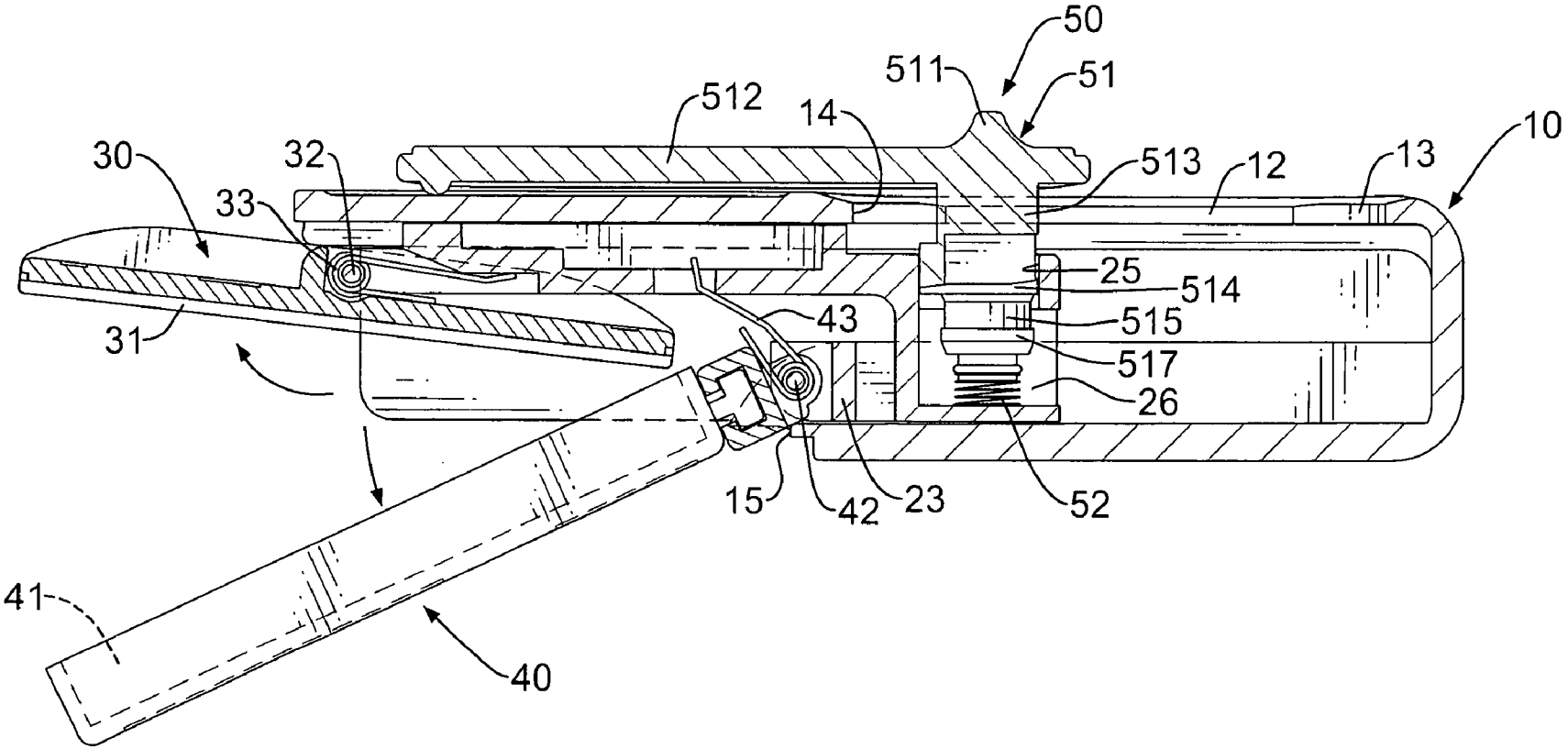
FIGS. 6–7 are schematic views showing that a character unit and an ink pad are pushed out from the housing of the portable stamp.
Figure 7:
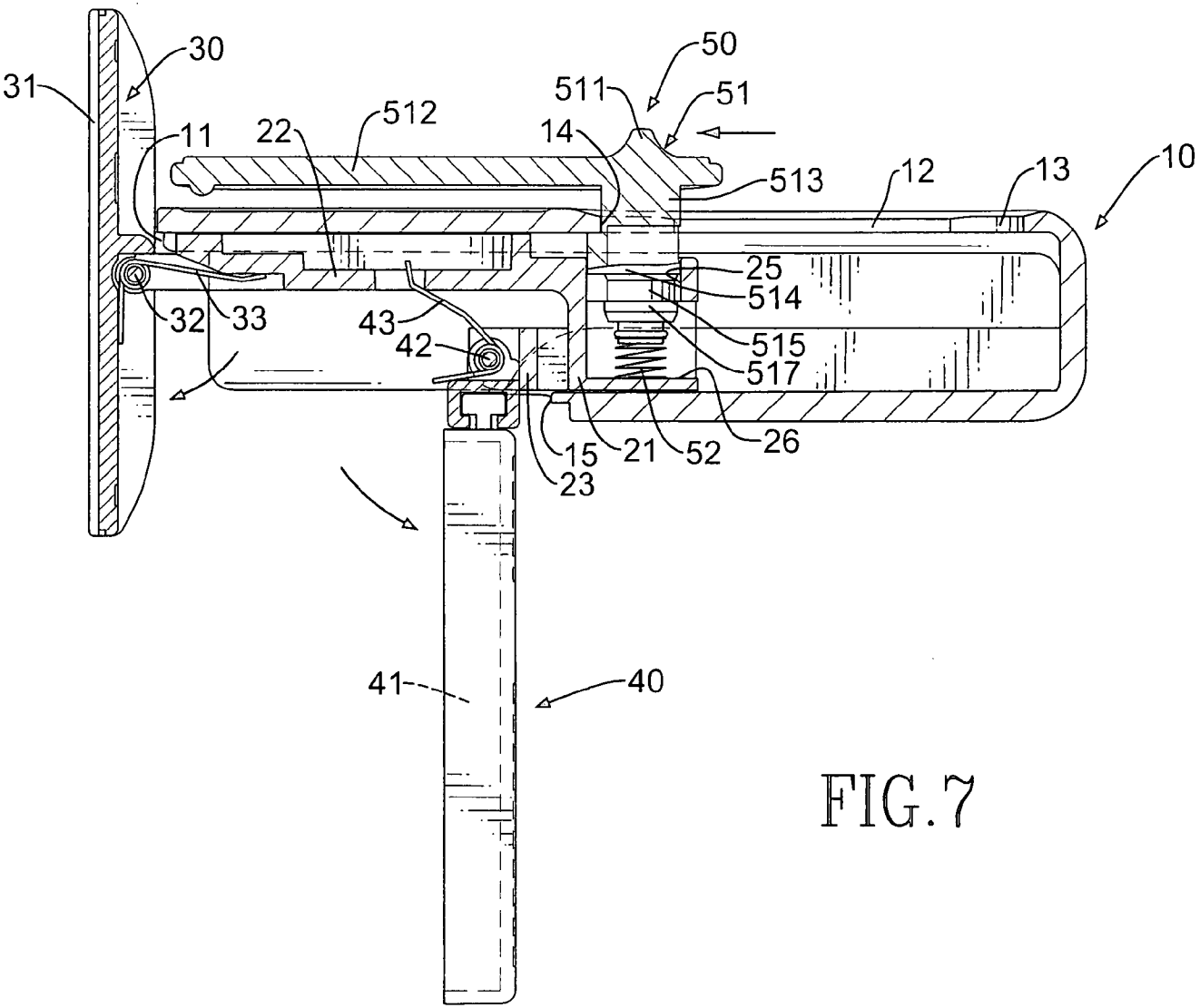

With reference to FIGS. 1–2, a portable stamp in accordance with the present invention is composed of a housing (10), a handle (20), a character unit (30), an ink pad (40), a control unit (50), and a cover (60).

The housing (10) has a hollow body (not numbered) with a U-like tongue (11) formed at an open end of the housing (10). An elongated slot (12) is defined through an upper side of the housing (10). A first hole (13) and a second hole (14), both of which have a diameter that is larger than a width of the elongated slot (12), are respectively defined at two ends of the elongated slot (12). A notch (15) is defined between two opposite sides of the tongue (11).

The handle (20) has a sliding block (21) movably mounted in the housing (10). A bar (22) extends from the sliding block (21) and is adjacent to the upper side of the housing (10). A seat (23) is formed beneath the bar (22) and is shorter than the bar (22). A space (24) is defined between the bar (22) and seat (23) for receiving the character unit (30) and ink pad (40). A positioning opening (25) is defined at a top side of the sliding block (21), and a lateral opening (26) is defined at a side perpendicular to the top side and in communication with the positioning opening (25).

The character unit (30) is pivotally mounted at a distal end of the bar (22) by a first pivot pin (32). A first torsion spring (33) is provided outside the first pivot pin (32). A character plate (31) is formed at a front surface opposite to the first pivot pin (32). The torsion spring (33) has a first end abutting the bar (22) and a second end abutting the character unit (30). Under the force of the first torsion spring (33), the character unit (30) is pivoted outwards about the first pivot pin (32) to a position perpendicular to the bar (22). When the character unit (30) is pivoted inwards for being received, the inner half of the character unit (30) will be located in the space (24).

The ink pad (40) is pivotally mounted at the seat (23) by a second pivot pin (42). A second torsion spring (43) is provided outside the second pivot pin (42). An ink sponge (41) is received in the ink pad (40) and faces the character unit (30). The second torsion spring (43) has a first end abutting the seat (23) and a second end abutting the ink pad (40). Under the force of the second torsion spring (43), the ink pad (40) is pivoted downwards to a position perpendicular to the seat (23). When the ink pad (40) is pivoted upwards for being received, the ink sponge (41) is close to the bar (22) and abuts the character plate (31).

The control unit (50) has a button (51) inserted in the positioning opening (25) and extending out from the first hole (13) when the handle (20), the character unit (30) and the ink pad (40) are received in the housing (10). A resilient member (52) is received in the lateral opening (26) and pressed under the button (51). The button (51) has a clip (512) formed at a top end thereof. A lug (511) is formed at a top surface of the clip (512). A neck (513) with a diameter substantially equal to the width of the elongated slot (12) is formed beneath the clip (512) and movable along the elongated slot (12). A stem (514), with a diameter substantially equal to the diameter of the first and second holes (13, 14), is formed beneath the neck (513). Two legs (515) are formed beneath the stem (514), and a gap (516) is defined between the two legs (515). Thus, the legs (515) can be deformed to be received in the positioning opening (25). Two stops (517) are respectively formed at outer sides of the legs (414). With reference to FIG. 2, the stops (517) are attached to a bottom edge of the positioning opening (25) to fasten the button (51) in the positioning opening (25). The resilient member (52) is pressed beneath the legs (515).

The cover (60) is mounted at the tongue (11) of the housing (10) to receive the character unit (30), and the ink pad (40).

The housing (10) further has a dovetail slot (16) defined at an upper wall thereof, and the bar (22) is formed with a dovetail cross section corresponding to the dovetail slot (16). Thus, the bar (22) is limited to move along the dovetail slot (16) in the housing (10).

With reference to FIG. 2, when the button (51) is positioned in the first hole (13), the handle (20) is received in the housing (10). Under the force of the resilient member (52), the button (51) is pushed upwards to position the stem (514) in the first hole (13). The character unit (30) is pivoted to abut the bar (22), and the ink pad (40) is pivoted to abut the character plate (31) with the ink sponge (41). The cover (60) is attached to the tongue (11) of the housing. Thus, a user can put the portable stamp in a pocket, or clip it on clothing by the clip (512).

With reference to FIGS. 3–7, in use, the cover (60) is first detached from the housing (10). Afterwards, the button (51) is pressed downwards to compress the resilient member (52), and the stem (514) is removed from the first hole (13), and the neck (513) is located in the first hole (13). Then, the button (51) can be pushed towards the tongue (11) along the elongated slot (12). When the button (51) arrives at the second hole (14), under the force of the second torsion spring (43), the ink pad (40) is pivoted downwards through the notch (15) to the position perpendicular to the handle (20). At the same time, the character unit (30) is pivoted outwards under the force of the first torsion spring (33) to the position perpendicular to the handle (20) and abutting the tongue (1).

Afterwards, the user releases the button (51), and the button (51) is pushed upwards by the force of the resilient member (52), and the stem (514) is blocked by the elongated slot (12). Thus, the character unit (30) can be used for stamping and will not be retracted. Furthermore, the character unit (30) will not be freely pivoted during the stamping procedure because the character unit (30) is blocked by the tongue (11).

Figure 8:
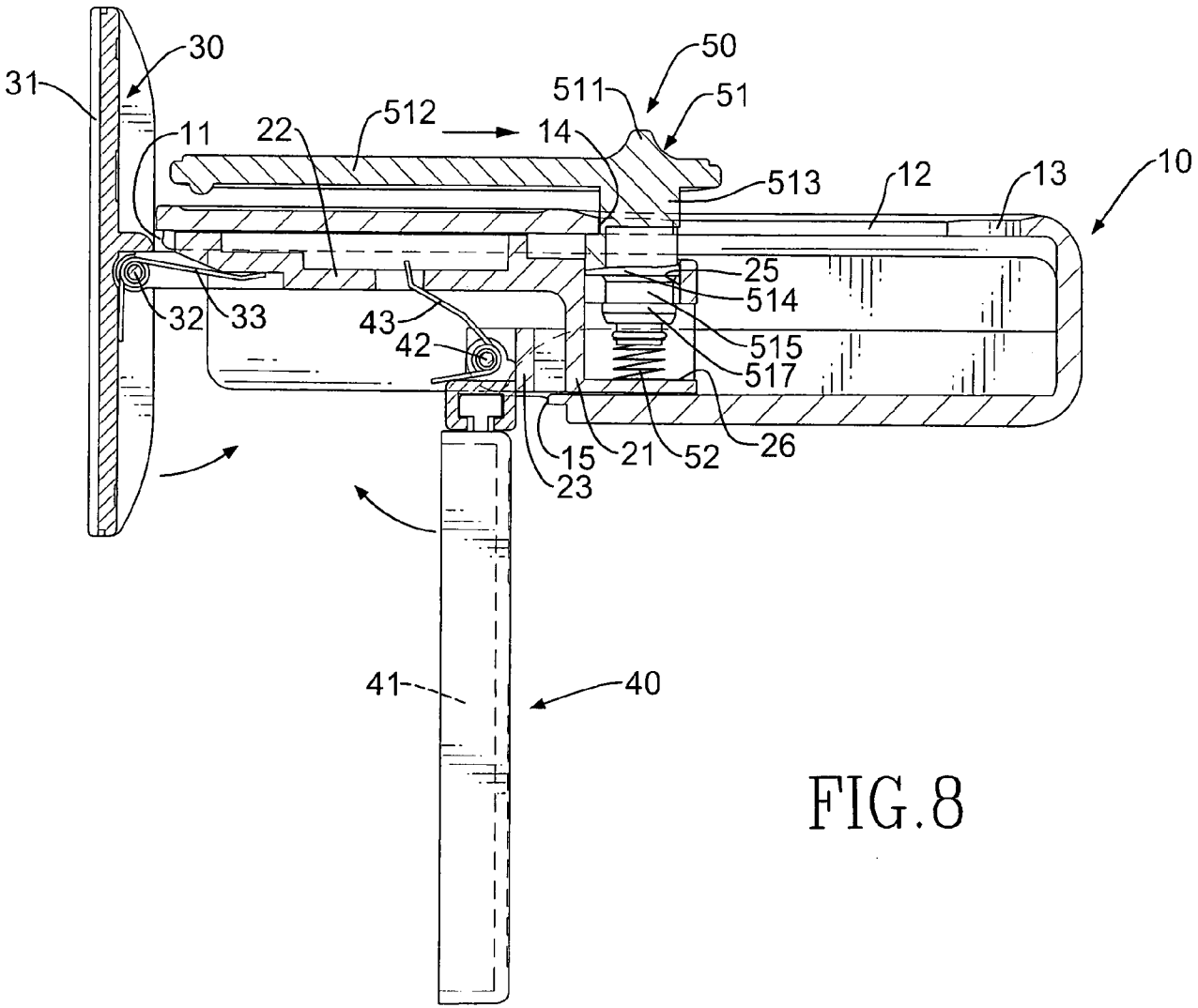
FIGS. 8–9 are schematic views showing that the character unit and ink pad are retracted in the housing.
Figure 9:
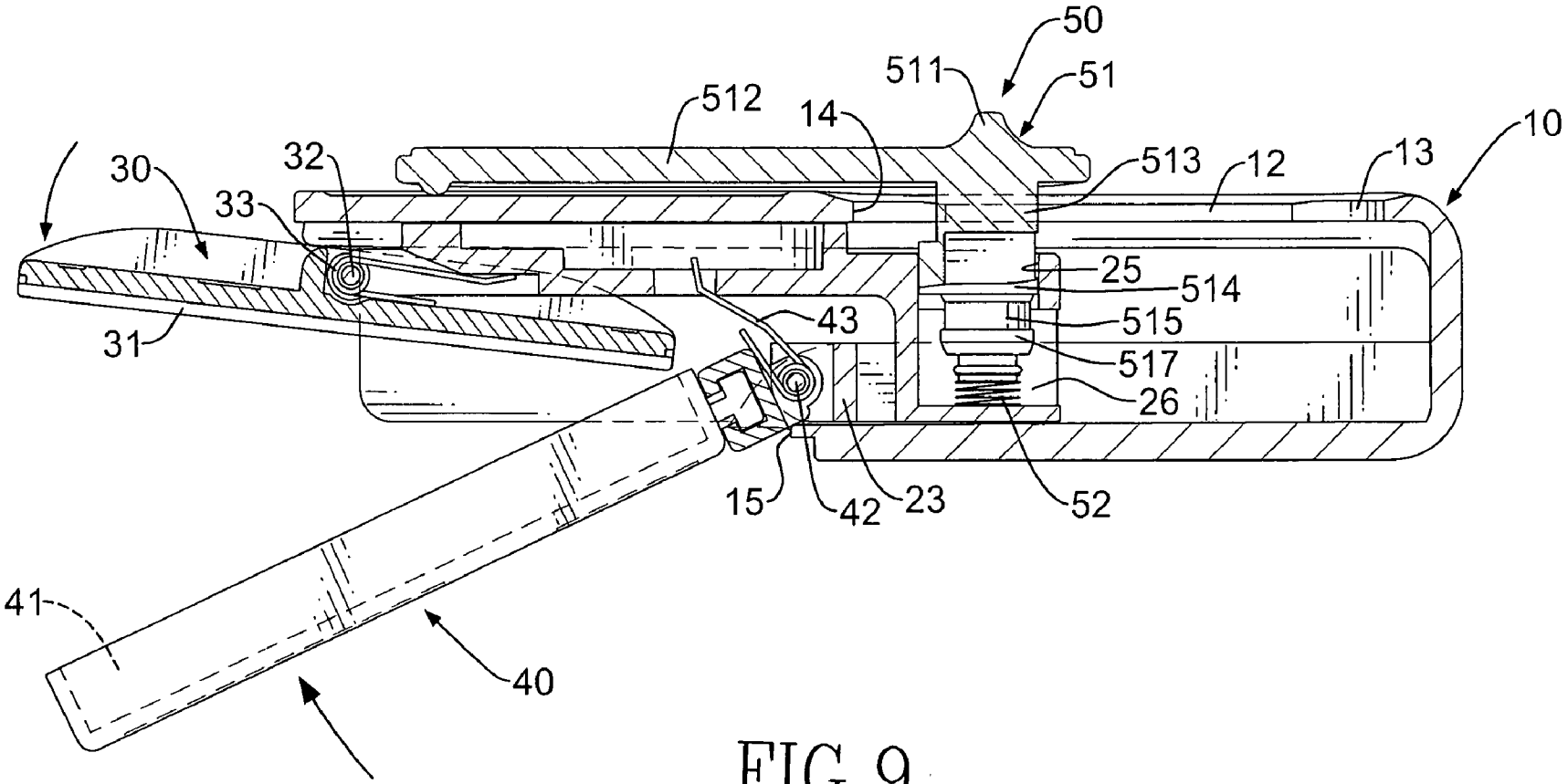

When the stamping procedure is finished, with reference to FIGS. 8 and 9, the user can press down the button (51) and push it towards the first hole (13). The character unit (30) is pushed by the tongue (11) to pivot inwards to abut the bar (22), and the ink pad (40) is pushed by a bottom edge of the housing (10) beside the notch (15) to pivot upwards to abut the character plate (31) again. Thus, the handle (20), the character unit (30), and the ink pad (40) are received in the housing (10). Thereafter, the cover (60) is attached to the housing (10).

In a situation that the character plate (31) will not have enough ink to print a clear mark, the user can recombine the character unit (30) and the ink pad (40) by means of the processing mentioned above to recoat the character plate (31) with ink. Thereafter, the character unit (30) is pushed outwards from the housing (10) again for further stamping.

Figure 10:
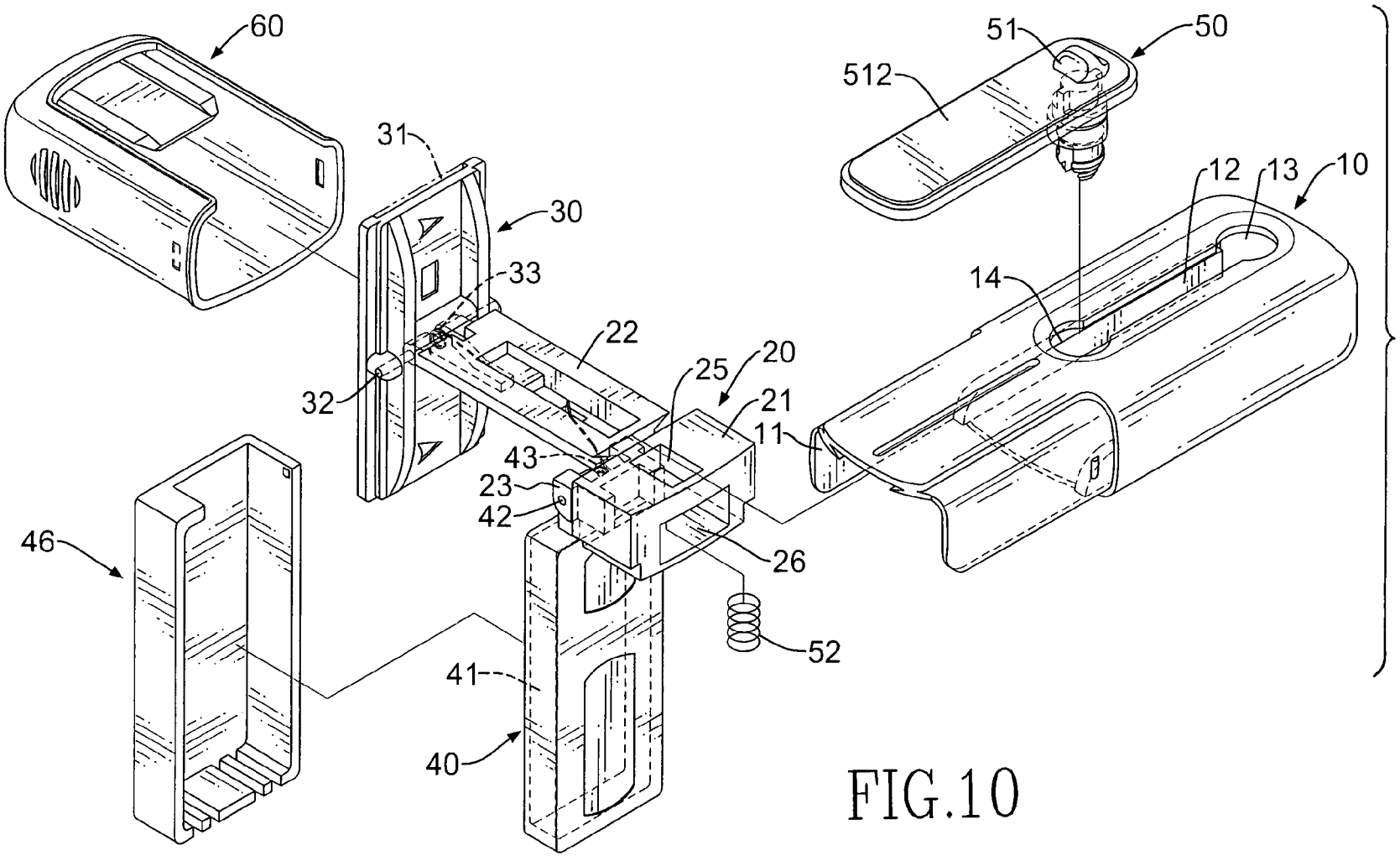
FIG. 10 is an exploded perspective view of another embodiment of the portable stamp.
Figure 11C:
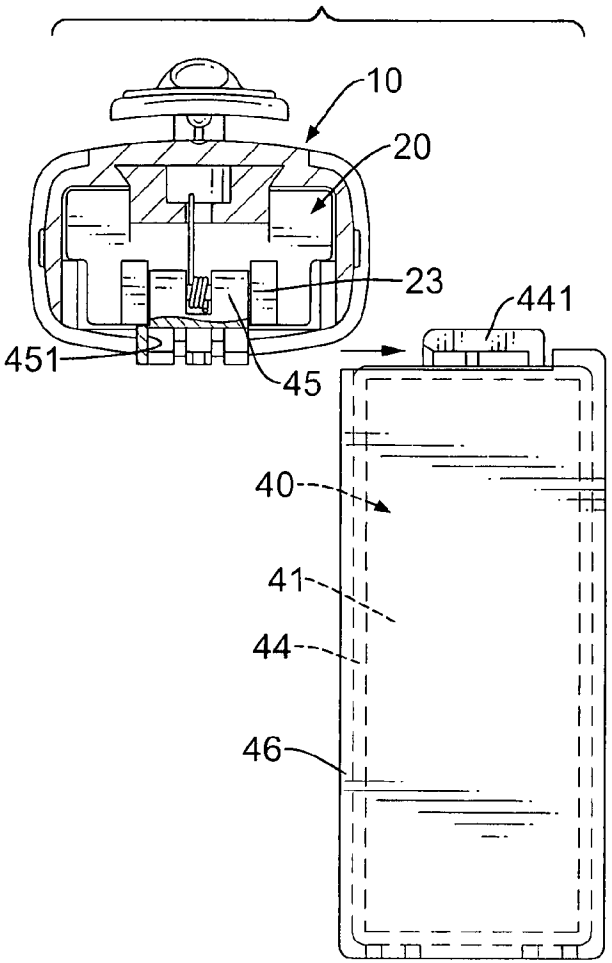
FIGS. 11A–C are schematic views of detaching the ink pad in the embodiment in FIG. 10.
Figure 11B:
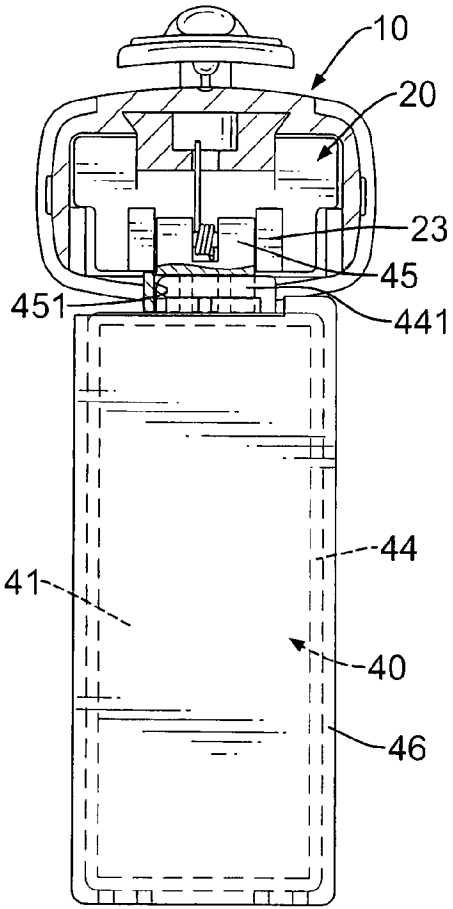
Figure 11A:
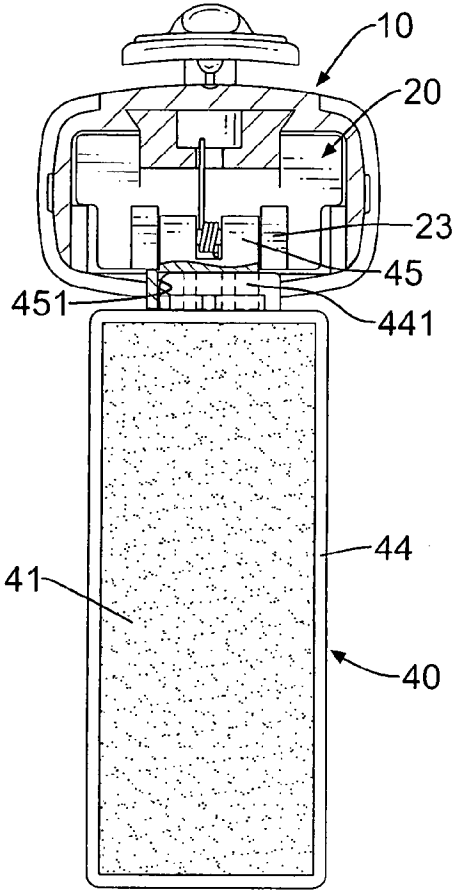
Figure 12:
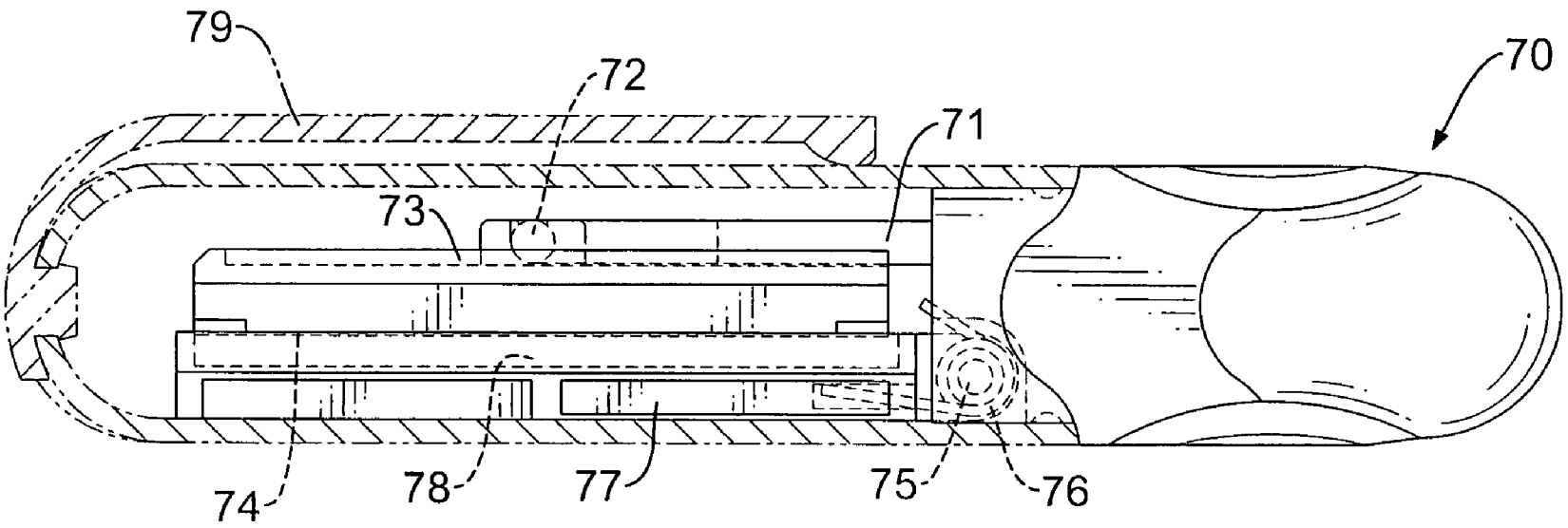
FIG.12 PRIOR ART
FIG. 12 is a front sectional view of a conventional portable stamp.
Figure 13:
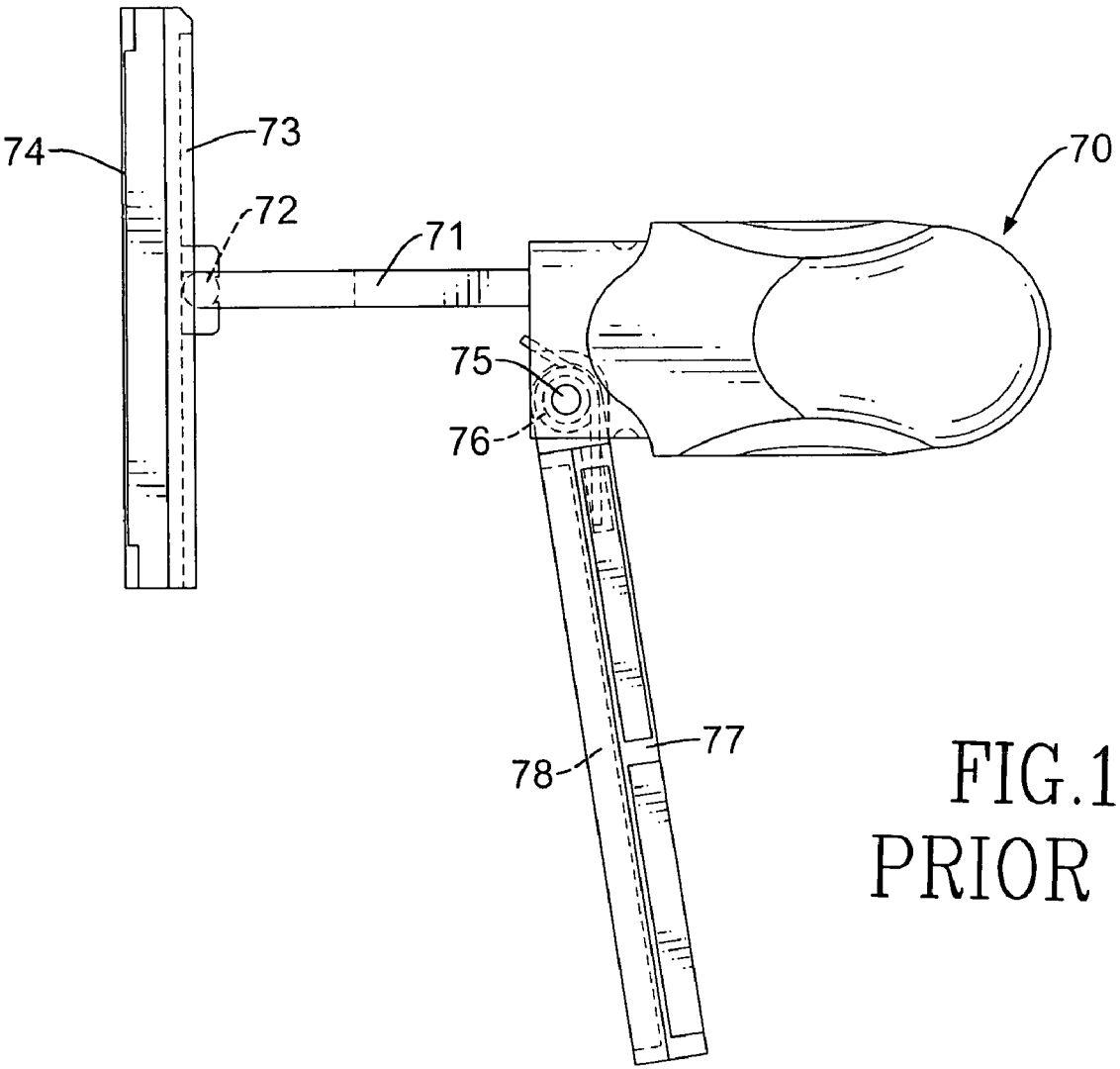
FIG.13 PRIOR ART
FIG. 13 is a schematic view of the conventional portable stamp in a used status.

With reference to FIGS. 10 and 11A, in another embodiment of the present invention, the ink pad (40') is detachably mounted on the seat (23). The ink pad (40') has a box (44) for receiving the ink sponge (41), and a finger (441) is formed at a top side of the box (44). A connector (45) is mounted on the second pivot pin (42) and has a passage (451) defined in the connector (45) for receiving the finger (441). A lid (46) is attached to the box (44) for covering the ink sponge (41).

With reference to FIGS. 11A–C, when ink in the ink sponge (41) is exhausted, the lid (46) can be attached to the box (44) to cover the ink sponge (41). Then, the user can directly detach the box (44) from the connector (45) by hand and replace it with a new box (44) with full ink. Because the ink sponge (41) is covered by the lid (46), the hand(s) of the user will not be dirtied.

Therefore, the portable stamp can be easily used by the user operating the control unit (50) and will not dirty the user's hands because the ink sponge (41) will not touch the user's hands. Furthermore, the character unit (30) in the stamping status is stably positioned by the first torsion spring (33) and the tongue (11), so it is easy to stamp the character plate (31) with an even pressure for printing a clear mark.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable stamp comprising:

a housing (10) having a hollow body with a U-like tongue (11) formed at an open end of the housing (10), an elongated slot (12) defined through an upper side of the housing, a first hole (13) and a second hole (14), both of which have a diameter that is larger than a width of the elongated slot (12), the first hole (13) and second (14) respectively defined at two ends of the elongated slot, and a notch (15) defined between two opposite sides of the tongue (11);

a handle (20) having a sliding block (21) movably mounted in the housing (10), a bar (22) extending from the sliding block (21) and adjacent to the upper side of the housing (10), a seat (23) formed beneath the bar

(22) and shorter than the bar (22), a space (24) defined between the bar (22) and seat (23), a positioning opening (25) defined at a top side of the sliding block, and a lateral opening (26) defined at a side perpendicular to the top side and in communication with the positioning opening (25);

a character unit (30) pivotally mounted at a distal end of the bar (22) by a first pivot pin (32), the character unit (30) having a first torsion spring (33) provided outside the first pivot pin (32), and a character plate (31) formed at a front surface of the character unit (30) opposite to the first pivot pin (32);

an ink pad (40) pivotally mounted at the seat (23) by a second pivot pin (42), the ink pad (40) having a second torsion spring (43) provided outside the second pivot pin (42), an ink sponge (41) received in the ink pad (40) and facing the character unit (30) and abutting the character plate (31); and a control unit (50) having a button (51) inserted in the positioning opening (25) and extending out from the elongated slot (12), and a resilient member (52) received in the lateral opening (26) and pressed against the button (51), wherein the button (51) has a lug (511) formed at a top of the button (51), a neck (513), with a diameter substantially equal to the width of the elongated slot (12), formed beneath the lug (511) and movable along the elongated slot (12), and a stem (514), with a diameter substantially equal to the diameter of either the first or second hole (13, 14), the stem (514) formed beneath the neck (513).

2. The portable stamp as claimed in claim 1, wherein the button (51) further has two legs (515) formed beneath the stem (514), a gap (516) defined between the two legs (515), and two stops (517) respectively formed at outer sides of the legs (414) and attached to a bottom edge of the positioning opening (25) for fastening the button (51) in the positioning opening (25), and the resilient member (52) is pressed beneath the legs (515).

3. The portable stamp as claimed in claim 2, wherein the control unit (50) further has a clip (512) formed between the lug (511) and the neck (513).

4. The portable stamp as claimed in claim 1 further comprising a cover (60) detachably mounted on the tongue (11) of the housing (10) to receive the character unit (30), and the ink pad (40).

5. The portable stamp as claimed in claim 1, wherein the housing (10) further has a dovetail slot (16) defined at an upper wall of the housing (10), and the bar (22) is formed with a dovetail cross section corresponding to the dovetail slot (16).

6. The portable stamp as claimed in claim 1, wherein the ink pad (40') has a box (44) detachably mounted on the seat (23) by a connector (45), the ink sponge (42) is received in the box (44), and a lid (46) detachably mounted on the box (44) for covering the ink sponge (42).

7. The portable stamp as claimed in claim 6, wherein the connector (45) is mounted on the second pivot pin (42) and has a passage (451) defined in the connector (45), and the box (44) has a finger (441) formed at a top side of the box (44) and inserted in the passage (451).

* * * * *